United States Patent [19]

Lulich

[11] Patent Number: 4,502,431

[45] Date of Patent: Mar. 5, 1985

[54] PRE-COMBUSTION ENGINE LUBRICATION SYSTEM

[76] Inventor: John F. Lulich, R.D. #3, Box 55, Blairsville, Pa. 15717

[21] Appl. No.: 471,669

[22] Filed: Mar. 3, 1983

[51] Int. Cl.[3] ..... F02N 11/08

[52] U.S. Cl. ..... 123/179 A; 123/196 S; 290/38 A

[58] Field of Search ..... 123/179 A, 196 R, 196 M, 123/196 S; 184/6.3; 290/38 A, 38 B

[56] References Cited

U.S. PATENT DOCUMENTS

| | | | |
|---|---|---|---|
| 2,102,514 | 12/1937 | Clarkson | 123/196 S |
| 2,178,756 | 11/1939 | Joost | 123/196 S |
| 2,357,606 | 9/1944 | Nutt | 123/196 R |
| 2,518,712 | 8/1950 | Ovens | 123/179 A |
| 2,707,463 | 5/1955 | Booth | 123/179 A |
| 2,838,039 | 6/1958 | Smith et al. | 123/196 S |
| 4,199,950 | 4/1980 | Hakanson et al. | 123/179 F |

FOREIGN PATENT DOCUMENTS

| | | | |
|---|---|---|---|
| 254306 | 12/1926 | United Kingdom | 184/6.3 |

*Primary Examiner*—Ira S. Lazarus
*Assistant Examiner*—R. S. Bailey
*Attorney, Agent, or Firm*—Reed Smith Shaw & McClay

[57] ABSTRACT

An internal combustion engine is provided with an oil pumping system operatively driven from the starter motor which generates normal operating oil pressure prior to combustion. The starter motor is energized with a first, lower level of electrical energy during its precombustion oiling operation and a second, higher level of electrical energy during its engine-cranking operation to conserve electrical energy and facilitate meshing between the starter gear and the engine flywheel.

12 Claims, 4 Drawing Figures

PRE-COMBUSTION ENGINE LUBRICATION SYSTEM

FIELD OF THE INVENTION

The present invention relates to oil pump mechanisms for internal combustion engines, and more particularly to a pre-combustion oil pump mechanism for use with large capacity diesel engines.

DISCUSSION OF THE TECHNICAL PROBLEM

The bearing surfaces in diesel engines are subjected to extreme loads because of the relatively high compression ratios necessary to effect combustion. Recently, the life expectancy of large capacity diesel engines such as are used in massive earth moving equipment has been deteriorating. This condition requires more frequent and expensive overhaul work to keep the engine operational. During such overhauls, it has been regularly observed that the crankshaft bearings are exhausted long before expected, even though they were properly installed and the oil supply system was operating as designed.

A variety of approaches have been previously attempted to alleviate this problem, one such approach being exemplified by U.S. Pat. Nos. 3,583,525; 3,583,527; 3,722,623; 3,917,027; 4,061,204; 4,094,293; 4,112,910; 4,157,744; and 4,199,950. These patents generally teach that the problem relates to a lack of lubrication at start-up, and disclose systems having an auxiliary oil accumulator which through appropriate valving bleed off and store a portion of the oil supply during normal engine operation and release it under pressure to the engine prior to or at the time of the next restart. This approach is limited, however, because large capacity diesel engines often require the pumping of up to five gallons of oil before normal operating oil pressures are attained at the initiation of engine operation. While the release of a lesser quantity of oil from an auxiliary oil accumulator might yield some benefit, there would still remain a period during which the engine was cycling prior to the time that full lubrication was provided the moving parts. Because space is already at a premium in engine compartments, it is unacceptable to include an auxiliary oil accumulator having a sufficiently large volume, and even if it were practical, use of such a large volume accumulator would tend to create large variations in the oil supply of the engine. Finally, inclusion of a pressurized oil reservoir within a hot engine compartment presents an unacceptable safety hazard due to the possibility of a rupture and spray of flammable liquid thereover.

Another approach is exemplified by U.S. Pat. Nos. 4,058,981 and 4,126,997, which disclose that inadequate start-up lubrication is the cause of the problem and teach a valve system which initially routes engine oil to more critical engine components such as the turbocharger and crankshaft bearings upon start-up, and thereafter to less critical engine components. This approach is beneficial, but since it does not become operative until engine parts begin relative movement, premature wear of critical engine elements is still a problem.

Another approach, exemplified by U.S. Pat. No. 3,045,420, involves the use of a plurality of oil pumps, each supplying oil to separate engine lubrication systems. The pump which supplies oil to the turbocharger unit of the engine is actuated prior to combustion, continues during engine operation, and continues to operate for a brief period after engine shutdown to protect the relatively sensitive high speed turbocharger bearings. This system may be beneficial in extending the turbocharger life expectancy, but it does not protect other vital engine components, it introduces substantial complexity into the lubrication system of the engine, and failure of the turbocharges pump would lead to turbocharger failure within seconds.

Finally, maufacturers of internal combustion engines are known to attempt to minimize the problem by incorporating relatively large capacity oil pumps in the lubricating system in order to minimize the period between initial combustion and when engine oil pressure reaches its normal operating level. This approach has not had the desired result of reducing wear and it introduces unnecessary weight, size and expense to the engine assembly.

SUMMARY OF THE INVENTION

It has been found that the extensive and premature wear of large capacity engines is due to a combination of factors, including inadequate start-up lubrication. A significant factor in premature wear was found to be the length of time the engine is not used and the lubricity of the oil. Newer high lubricity oils increase the fuel economy of the engine, but they also tend to exacerbate the wear when engines are not operated for periods of time. Such oils tend to leave a smaller measure of residual oil on bearing surfaces when an engine is not in use, and as a result, bearings are left relatively unlubricated during the initial start-up period. Therefore the present invention provides a relatively simple and effective mechanism to extend the life of the bearing surfaces of an internal combustion engine, by assuring that an adequate oil supply is provided to the bearing surfaces before any relative movement of engine parts occurs.

In the conventional diesel engine, the oil pump mechanism is driven by gears from the crankshaft. Thus, oil is not directly provided to engine parts until after such parts have begun moving. Depending upon the size of the engine and the capacity of the pumping mechanism, full oil pressure is normally not obtained in the system for five or more seconds after cranking begins. Only residual oil remaining on the bearing surfaces from the previous operation provides lubrication and protection until a new supply of oil is provided by the pump.

In the practice of the present invention, oil is pumped within the engine passageways prior to cranking for a period sufficient to provide an operational oil pressure level before any engine parts begin to move. In this manner, all bearing surfaces are fully lubricated in advance of their load-bearing operation and life expectancy is substantially increased.

Although not limiting to the invention, this result may be accomplished by providing a supplemental oil pump which is conveniently driven from the starter motor armature shaft of the diesel engine. When the starter switch of the diesel engine is moved to its heat position to activate the glow plugs, an electrical impulse is also provided to initiate the rotation of the starter motor armature shaft to drive the supplemental oil pump, thereby bringing oil pressure up to operational levels while the operator waits to initiate cranking. When the starter motor clutch is actuated to turn the crankshaft to initiate combustion, both the main and supplemental oil pumps become operative. As the starter motor automatically disengages and is de-energized upon combustion, the supplemental oil pump stops. A main oil pump that is smaller and less expensive than normally utilized is sufficient to maintain the already-established oil pressure.

DESCRIPTION OF THE PREFERRED EMBODIMENT

Figure 1:
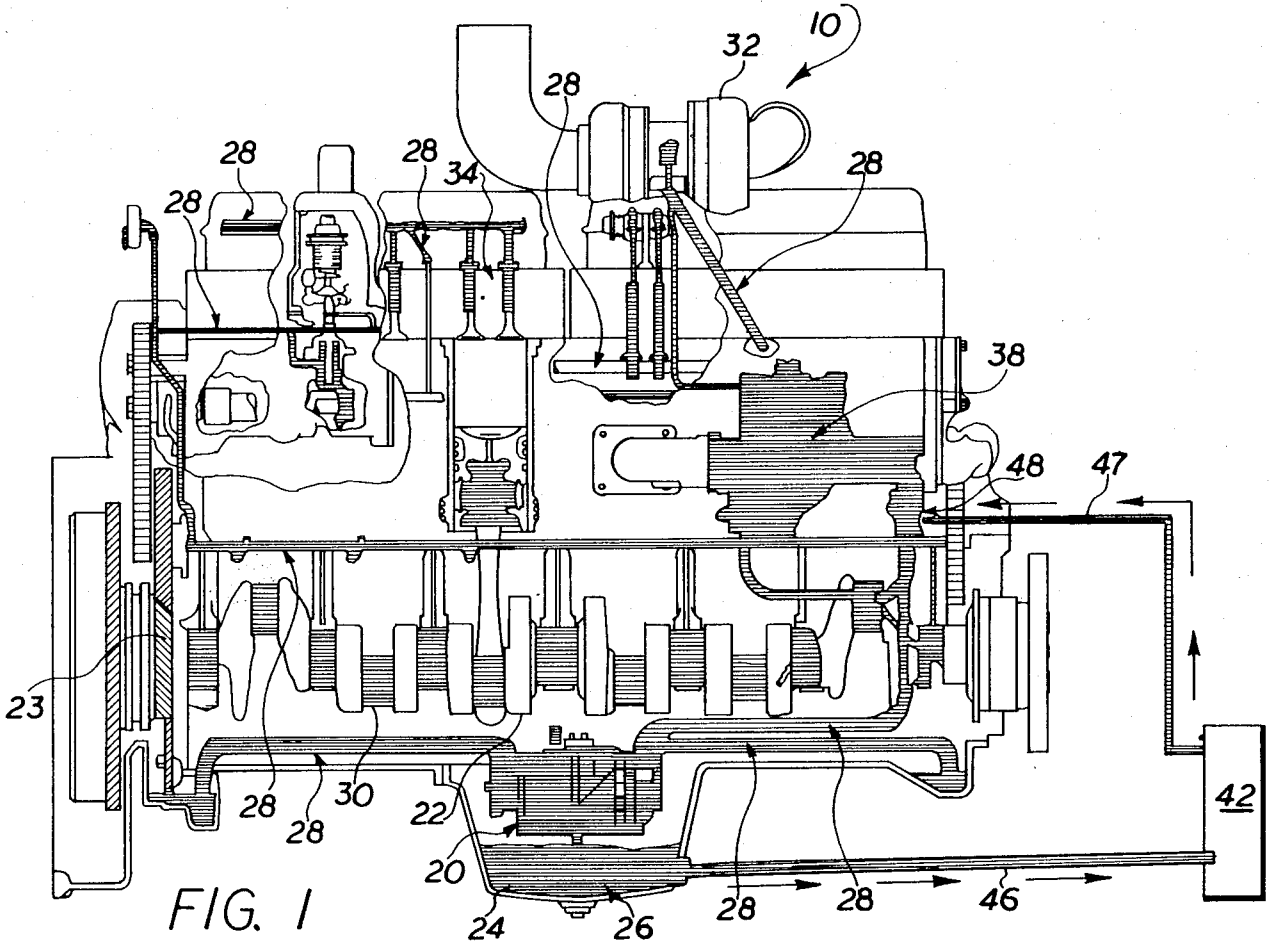
FIG. 1 is a side view in partially schematic form of a diesel engine including features of the present invention, with portions broken away or not shown for purposes of clarity.

With reference to FIG. 1, there is shown a diesel engine 10 having portions removed and/or broken away to better illustrate the lubrication system thereof. Generally, the lubrication system includes a main oil pump 20 which is mechanically driven from the crankshaft 22 of engine 10. When actuated by rotation of crankshaft 22, main oil pump 20 draws oil from a sump 24 through a screening element 26 and distributes it under pressure through a plurality of conduits 28 to the engine's crankshaft bearings 30, to the turbocharger unit 32, to the valve train assembly 34, to the pistons 36, to and through a filtering assembly 38, and to other engine components requiring lubrication. As taught in U.S. Pat. Nos. 4,058,981 and 4,126,997, valving (not shown) may be included within the lubrication system to control the sequence in which oil is provided to the various engine components. As discussed before, main oil pump 20 is not actuated until crankshaft 22 begins to rotate due to the operation of an electromechanical starter assembly 40. Because a significant time period, e.g., five seconds, lapses before the main oil pump 20 is able to achieve normal operating oil pressure in the lubrication system, vital engine components may move through a large number of cycles with inadequate lubrication, resulting in undesirably high wear and premature failure.

Figure 2:
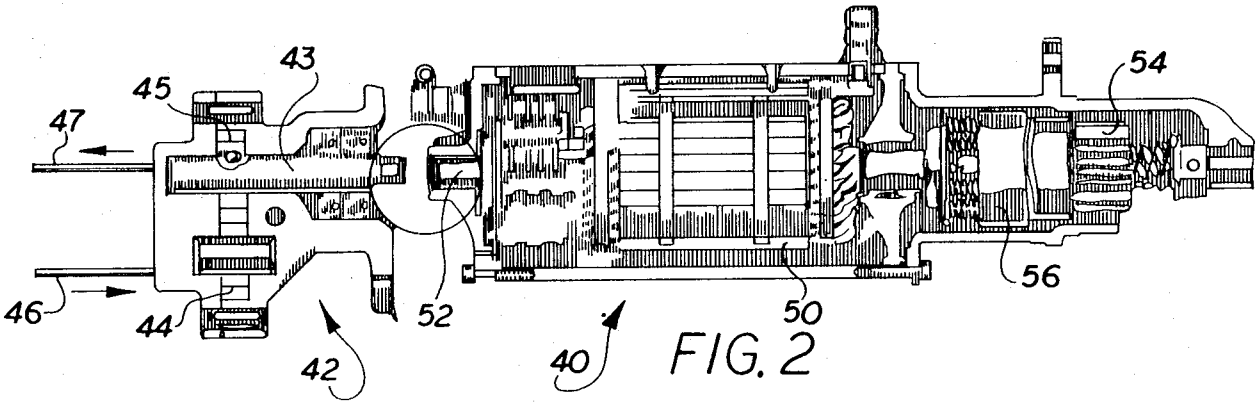
FIG. 2 is a sectional side view of a starter and pre-ignition oil pump mechanism useful with the diesel engine shown in FIG. 1, incorporating features of the present invention.
Figure 3:
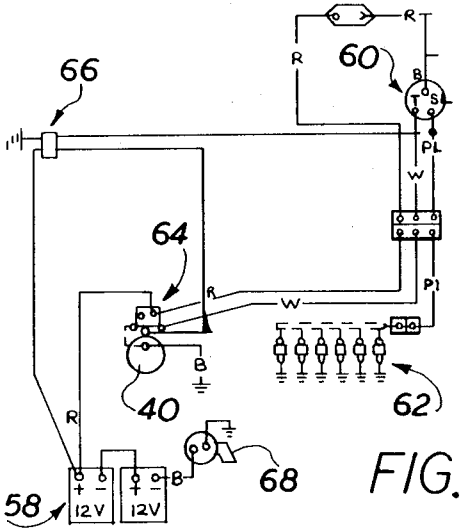
FIG. 3 is a schematic diagram of the electrical system useful with the mechanisms shown in FIGS. 1 and 2, incorporating features of the present invention.

In the practice of the present invention there is conveniently provided a pre-combustion lubrication system which operates prior to crankshaft rotation to achieve normal operating oil pressure before engine components begin relative motion. Although not limiting to the invention, the pre-combustion lubrication system according to the present invention preferably includes a supplemental oil pump 42 which is operatively connected to starter assembly 40. With particular reference to FIGS. 2 and 3, there is shown a mechanically driven gear-type oil pump 42 having an elongated drive shaft 43, and gears 44 and 45. Oil Pump 42 communicates with the engine lubrication system through an oil inlet line 46, an oil output line 47, and a check valve 48.

Starter assembly 40 may be conventional in configuration and includes a D.C. motor assembly 50 having an armature shaft 52 extending therethrough. Armature shaft 52 supports a starter gear 54 adjacent one end which engages flywhell 23 to rotatably drive crankshaft 22 when actuated, and a bendix drive mechanism 56 controls the axial movement of the starter gear 54 to engage and disengage it from the flywheel 23. According to the present invention, drive shaft 43 of oil pump 42 may be connected to the armature shaft 52 of starter motor 40 opposite starter gear 54 in any convenient manner so that the two shafts rotate together. Although not so shown in FIG. 2, oil pump 42 and starter motor 40 may be conveniently incorporated within a single housing to form an integral unit.

With reference to FIG. 3, a schematic diagram illustrates a preferred electrical configuration useful in the practice of the present invention with large capacity diesel engines.

The electrical system includes a pair of 12 volt batteries 58, a three position starter switch assembly 60, a plurality of glow plugs 62, a first solenoid 64 and a second solenoid 66 electrically communicating with starter assembly 40, and a disconnect switch 68.

With reference to FIGS. 2 and 3, in a typical prior art diesel electrical system, the disconnect switch 68 serves to disconnect the batteries 58 from the remainder of the electrical system. The three position starter switch assembly 60 has an off position, a heat position, and a cranking position. In the off position, as would be expected, the electrical system of the engine is inoperative. In the heat position, the glow plugs 62 are electrically activated to provide heat to the cylinders to facilitate initial combustion, but the starter assembly 40 remains electrically inactivated. In the cranking position, 24 volts of electrical energy are provided from batteries 58 to first solenoid 64 adjacent starter assembly 40. First solenoid 64 energizes the electrical motor of starter assembly 40 to initiate rotation of armature shaft 52 while at the same time it energizes bendix drive mechanism 56 to engage starter gear 54 with flywheel 23. When the engine starts, starter gear 54 automatically disengages from flywheel 23 and first solenoid 64 may be deactivated to electrically disconnect the starter assembly 40.

With this general appreciation of conventional diesel engine electrical systems, and with continued reference to FIGS. 2 and 3, the following discussion should provide an understanding of the operation and benefits of the present invention. According to the present invention the three position starter switch assembly 60 has an off position, a heat and pump position, and a cranking position. The off position renders the electrical system of the engine inoperative. In the heat and pump position, the glow plugs 62 are activated with 24 volts of electrical energy to provide heat to the cylinders, but unlike in the conventional diesel electrical system, the starter assembly 40 is also electrically energized in a novel and beneficial manner. In particular, the present invention includes second solenoid 66 which energizes the electrical motor 50 of starter assembly 40 when the switch assembly 60 is in the heat and pump position, but does not energize the bendix drive mechanism 56 to engage the starter gear 54 with flywheel 23. Through this arrangement the rotatable shaft 52 of the starter assembly 40 may be driven to rotate the drive shaft 43 of oil pump 42 to initiate the pumping of oil therethrough, prior to the cranking of the engine. The oil pump 42 remains energized during the entire preheat period and is able to achieve normal operating oil pressures throughout the engine prior to combustion, thereby assuring that the movable engine parts are lubricated during their initial cyclings.

When the glow plugs 62 have provided sufficient heat for initial combustion, the switch assembly 60 is moved to its cranking position, thereby deactivating second solenoid 66 and glow plugs 62, and activating first solenoid 64. First solenoid 64 reactivates the electric motor 50 of starter assembly 40 to rotate armature shaft 52 and also energizes bendix mechanism 56 to urge starter gear 54 into engagement with flywheel 23 to crank the engine.

During the cranking portion of the starting sequence, oil pump 42 is operatively driven from the armature shaft 52 of starter assembly 40, while main oil pump 20 is operatively driven by the rotation of crankshaft 22. Thus, during this critical period of engine operation both oil pumps 42 and 20 contribute to assure that normal operating oil pressures are achieved and maintained. This feature of the invention eliminates the need for engine manufacturers to incorporate larger than necessary main oil pumps in their diesel engines to assure that oil pressure reaches normal operating levels quickly after combustion begins.

Figure 4:
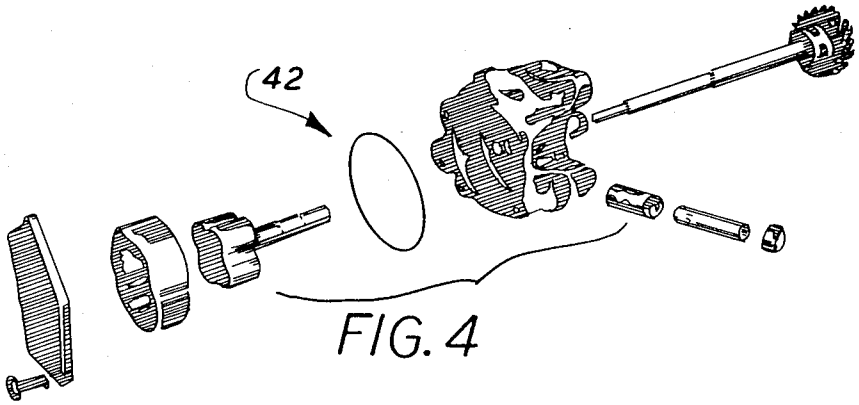
FIG. 4 is an exploded perspective view of an alternative supplemental oil pump useful in the practice of the present invention.

Although not limiting to the invention, and with continued reference to FIG. 3, it is preferred that when the switch assembly 60 is in its heat and pump position, second solenoid 66, and accordingly starter assembly 40, are energized with only 12 volts of electrical energy from batteries 58. This may be effected by electrically connecting second solenoid 66 to one of batteries 58, or more as preferably shown in FIG. 3, by including an appropriate resistor in series with second solenoid 66. This feature of the invention provides at least two benefits; it conserves electrical energy in the batteries 58 which may later be needed for cranking, and it reduces the rotational speed of armature shaft 52 during the heat and pump portion of the starting sequence. As can be appreciated, the starter assembly 40 is able to drive an appropriately selected oil pump 42 with sufficient torque to achieve normal operating oil pressures in the engine prior to combustion even when it is only energized by 12 volts of electrical energy because during the heat and pump portion of the starting sequence it is not simultaneously cranking the engine. As shown in FIG. 2, gear-type oil pump 42 may be selected for use with the present invention. Alternatively, as shown in FIG. 4, a Model 601-1055 rotor-type oil pump available from the Balkamp Company of Indianapolis, Ind. has been found to operate satisfactorily to achieve normal operating oil pressures prior to combustion when driven at the rate of about 1200 r.p.m. by armature shaft 52.

When the switch assembly 60 is moved from the heat and pump position to the cranking positon, there may be a very brief period during which the starter assembly 40 is not electrically powered. The drag of the oil pump 42 during this brief period of transition preferably is sufficient to slow the rotation of armature shaft 52 to thereby facilitate the meshing of starter gear 54 with flywheel 23 when starter assembly 40 is reactivated with 24 volts of electrical energy. Thus, this feature of the invention eliminates the need for more elaborate clutching assemblies which might otherwise be needed if the starter assembly 40 was energized with 24 volts during both the heat and pump and the cranking portion of the starting sequence.

When the engine starts, the starter assembly 40 automatically disengages from the flywheel 23 and may be de-energized with switch assembly 60, thereby deactivating oil pump 42. Thenceforth, the main oil pump 20 need only maintain the oil pressures previously generated by the oil pump 42 during the heat and pump portion, and by both oil pumps 42 and 20 during the cranking portion of the starting sequence. Check valve 48 is mounted on the engine adjacent outlet line 47 to present oil backflow while oil pump 42 is inoperative, to prevent oil flow from spinning starter assembly 40 during normal engine operation.

As an additional benefit, practice of the present invention is virtually a failsafe system, because a failure of the supplemental oil pump 42 would not render the engine inoperative, thereby avoiding costly down-time for the equipment. Likewise, because the supplemental oil pump 42 pumps oil throgh the filtering assembly 38 before the oil enters the engine, failure of supplemental oil pump 42 would not introduce damaging particles into the engine.

While the present invention has been principally described in relation to large scale diesel engines where it is particularly beneficial, it is recognized that the invention is also useful in a wide variety of other types of internal combustion engines. For example, use of the invention in automotive applications is contemplated, both in diesel and in conventionally sparked engines. In the latter group of engines, there has been designed an auxiliary, starter-driven oil pump which provides precombustion lubrication controlled by a time-delay ignition switch, and which is as small in size as a conventional pocket watch. Accordingly, the present invention is not intended to be limited in scope by the description of the preferred embodiment provided above, but rather, only by the claims which follow.

What is claimed is:

1. In an internal combustion engine having a plurality of movable parts which require lubrication during relative movement to reduce wear;

an electromechanical engine starter mechanism for initiating movement within said engine and having an armature shaft; and an oil supply system having a main oil pump which circulates oil to said movable parts in response to movement within said engine;

the improvement comprising:

means for activating said starter mechanism in a first mode of operation in which movement is not initiated within said engine and in a second mode of operation in which movement is initiated within said engine to effect combustion;

and a supplemental oil pump communicating with said oil supply system and including a rotatable drive shaft operatively connected to said armature shaft starter mechanism to pump oil within said oil supply system in response to at least said first mode of operation of said starter mechanism.

2. The engine as set forth in claim 1, further comprising:

switching means for engaging said first mode of starter mechanism operation for a controllable time period prior to engagement of said second mode of starter mechanism operation, to generate oil pressure in said engine prior to initiating movement of said plurality of movable parts therein.

3. The engine as set forth in claim 2, wherein said supplemental oil pump pumps oil in response to both said first and second modes of operation of said starter mechanism, wherein said main oil pump pumps oil in response to said second mode of operation, and wherein said controllable time period is of a sufficient duration such that normal operating oil pressures are achieved in said engine during said first mode of operation.

4. The engine as set forth in claim 3, further comprising means for automatically terminating said second mode of starter mechanism operation upon combustion in said engine, whereby said supplemental oil pump becomes inoperative.

5. The engine as set forth in claim 4, further comprising oil check valve means for isolating said supplemental oil pump from said oil supply system when said supplemental oil pump is inoperative.

6. The engine as set forth in claim 5, wherein said engine is a diesel engine including means for preheating prior to initial combustion, wherein said switching means actuates said preheating means while engaging said first mode of starter mechanism operation.

7. The engine as set forth in claim 6, wherein said activating means provides a first electrical voltage to said starter mechanism during said first mode of operation and a second electrical voltage to said starter mechanism during said second mode of operation.

8. The engine as set forth in claim 7, wherein said first voltage is less than said second voltage to facilitate a smooth transition by said starter mechanism from said first mode of operation to said second mode of operation.

9. The engine as set forth in claim 5, wherein said engine is a conventionally sparked engine suitable for use in road going vehicles.

10. In an electromechanical starter mechanism having an electric motor, a rotatable armature shaft, a starter gear connected to rotate with said rotatable armature shaft, and means for urging said starter gear into and out of engagement with the flywheel of an internal combustion engine, the improvement comprising:

a pump mechanism connected to said rotatable armature shaft and actuated by rotation thereof, said pump mechanism able to communicate with the lubrication system of an internal combustion engine to which said starter mechanism is engageable through oil inlet and oil outlet orifices;

first means for energizing said starter mechanism to both actuate said starter gear urging means and rotate said rotatable armature shaft; and second means for energizing said starter mechanism to rotate said rotatable armature shaft without actuating said starter gear urging means.

11. The starter mechanism as set forth in claim 10, wherein said first energizing means is a first solenoid controlling said starter gear urging means, and wherein said second energizing means is a second solenoid which is independent of said starter gear urging means.

12. The starter mechanism as set forth in claim 11, wherein said first solenoid energizes said starter mechanism with a first, relatively higher electrical voltage and wherein said second solenoid energizes said starter mechanism with a second, relatively lower electrical voltage.

* * * * *